US010882167B2

(12) United States Patent
Moore et al.

(10) Patent No.: US 10,882,167 B2
(45) Date of Patent: Jan. 5, 2021

(54) CRIMPING DEVICES INCLUDING A PISTOL-GRIP AIR HAMMER AND A CRIMP SOCKET WITH A SLOPED KEY

(71) Applicant: Toyota Motor Engineering & Manufacturing North America, Inc., Plano, TX (US)

(72) Inventors: Ronald Keith Moore, Newburgh, IN (US); Sean W. Hatchett, Evansville, IN (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 177 days.

(21) Appl. No.: 16/142,820

(22) Filed: Sep. 26, 2018

(65) Prior Publication Data

US 2020/0094387 A1 Mar. 26, 2020

(51) Int. Cl.
*B25B 27/00* (2006.01)

(52) U.S. Cl.
CPC ..... *B25B 27/0035* (2013.01)

(58) Field of Classification Search
CPC . B25B 27/0035; B25B 27/026; B25B 13/485; A01G 3/033
See application file for complete search history.

(56) References Cited

U.S. PATENT DOCUMENTS

| | | | | |
|---|---|---|---|---|
| 4,128,038 | A * | 12/1978 | Urwin | B25B 13/485 411/403 |
| 4,821,683 | A * | 4/1989 | Veldman | A01G 3/033 123/46 SC |
| 2003/0213339 | A1 | 11/2003 | Bellanca | |
| 2013/0118766 | A1 | 5/2013 | Watanabe | |

FOREIGN PATENT DOCUMENTS

| | | | |
|---|---|---|---|
| CN | 204382227 | U | 6/2015 |
| DE | 102015226423 | A1 | 6/2017 |
| FR | 2931091 | A1 | 6/2010 |
| JP | 2000271877 | A | 10/2000 |

* cited by examiner

*Primary Examiner* — Lee A Holly
(74) *Attorney, Agent, or Firm* — Dinsmore & Shohl LLP

(57) ABSTRACT

A crimping device includes a hammer and a crimp socket that includes an aperture, a socket face, and a sloped key that projects radially into the crimp socket and extends at least a portion of the depth of the aperture. A height of the radial projection of the sloped key increases along a depth of the aperture.

10 Claims, 3 Drawing Sheets

CRIMPING DEVICES INCLUDING A PISTOL-GRIP AIR HAMMER AND A CRIMP SOCKET WITH A SLOPED KEY

TECHNICAL FIELD

The present specification generally relates to crimping devices and, more specifically, to crimping devices including a pistol-grip air hammer and a crimp socket with a sloped key.

BACKGROUND

Vehicles include one or more wheel assemblies including one or more wheels. Each of the one or more wheel assemblies may be positioned at a lateral end of an axle. A wheel may be locked in place along a length of the axle such that it cannot move relative to the end of the axle. That is, the position of the wheel may be fixed in the lateral direction with respect to the axle. One or more components may be used to lock the wheel in place along the axle. For example, an axle nut may be one of the components used to lock the wheel in place. Accordingly, a need exists for locking a lateral position of an axle nut along the length of an axle.

SUMMARY

In one embodiment, a crimping device includes a hammer and a crimp socket that includes an aperture, a socket face, and a sloped key that projects radially into the crimp socket and extends at least a portion of the depth of the aperture. A height of the radial projection of the sloped key increases along a depth of the aperture.

In another embodiment, a method of crimping an axle nut to an axle includes positioning a crimp socket including an aperture, a socket face, and a sloped key that projects radially into the crimp socket and that extends at least a portion of the depth of the aperture over the axle, and moving the crimp socket in an axial direction to crimp down on a portion of the axle nut to crimp the portion into a slot of the axle.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Wheel assemblies may include wheels that are attached to an axle at a wheel hub. Translational motion of the wheel hub may be inhibited by an axle nut. That is, the axle nut may inhibit the wheel from translating off of the axle in the vehicle lateral direction. Axle nuts may be threaded onto an end of the axle and threads may inhibit lateral translation (i.e., in the axial direction) of the axle nut, thus inhibiting translational movement of the wheel hub and the wheel in the axial direction. Still, it may be possible for the axle nut to rotate with respect to the axle and the threads may cause the axle nut to translate outward loosening the wheel hub. Accordingly, some structure (e.g., a physical interlock) may be required for inhibiting relative rotation between the axle nut and the axle. One possible type of interlock is a crimp.

Crimps may inhibit relative rotation between the axle nut and the axle and lock the axle nut to the axle. Accordingly, some device for making a crimp in the axle nut may be desirable. Current devices for crimping axle nuts to axles may require two handed operation. Such two handed operation may require rotation of the crimping device to align the crimping device with the axle nut. If a user is holding a crimping device with two hands, he or she must rotate the entire crimping device in order to align the crimping device and the axle nut. Accordingly, given the current arrangement, all of a user's hands may be occupied, leaving no hand for manipulating an adaptor for physically coupling the crimping device and the axle nut. Accordingly, either two users must cooperate to turn the air hammer to align the adaptor and the assembly to be crimped or the user must turn the air hammer alone.

A pistol-grip air hammer may be lighter and require only one hand for operation. Accordingly, a user may have a second hand free to rotate an adaptor that may couple the pistol-grip air hammer to an assembly to be crimped. This may save a user time and make it more likely that he or she is able to successfully crimp a workpiece.

Figure 1:
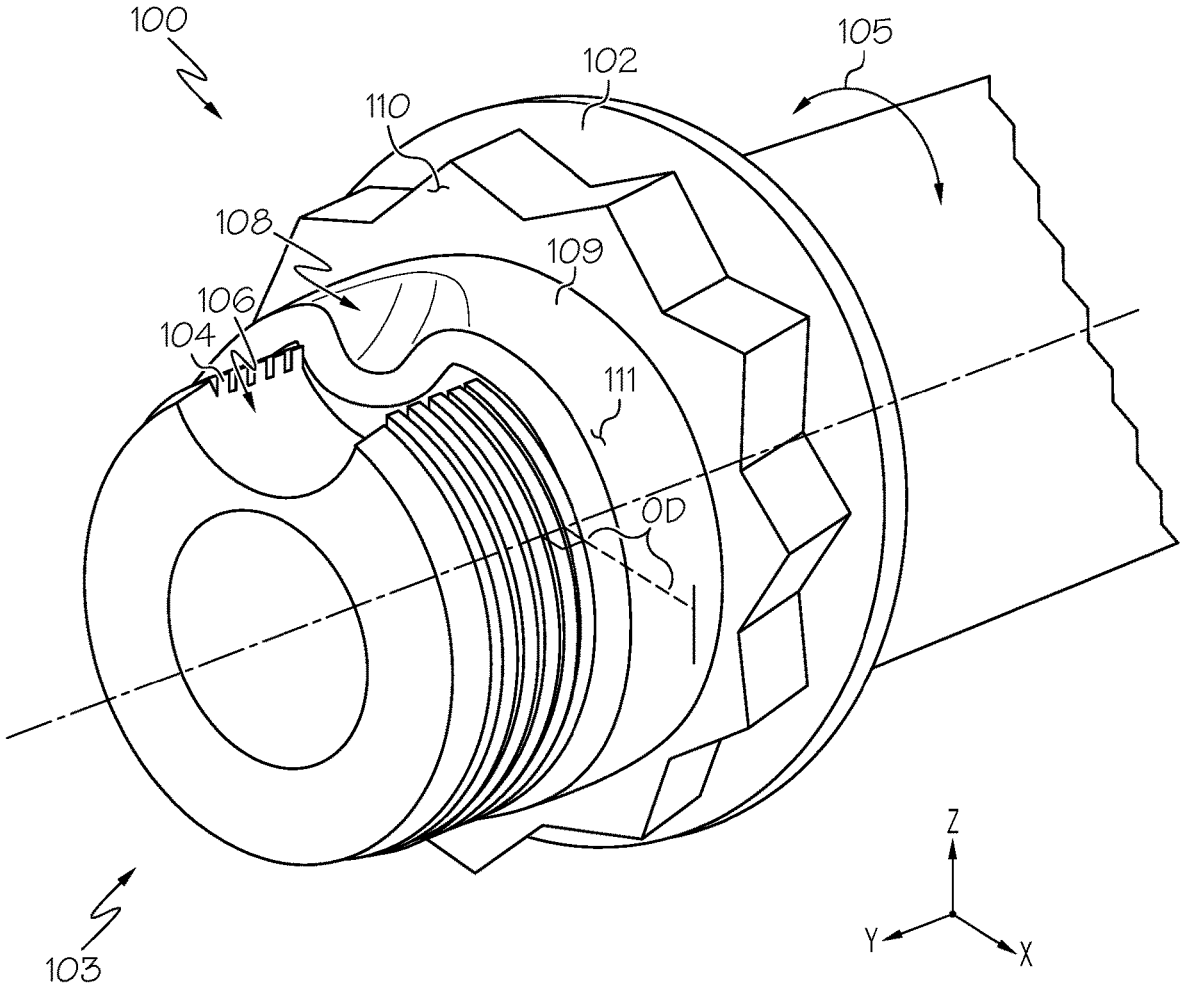
FIG. 1 depicts an axle of a vehicle including an axle nut, according to one or more embodiments shown and described herein.

FIG. 1 depicts an axle 100 that extends through an axle nut 102 that is affixed to a distal end 103 of the axle 100. The axle 100 may have a generally circular profile. A plurality of threads 104 are disposed at the distal end 103. The distal end 103 of the axle 100 may be substantially mirrored at an opposite end of the axle 100. The axle nut 102 may have an inner surface with a corresponding circular profile and threads that correspond with the threads 104 of the axle 100. The axle nut 102 may be threaded onto the axle 100 and the threads 104 of the axle 100 and the threads of the axle nut 102 may inhibit the axle nut 102 from moving in an axial direction (+/−Y direction) and relative rotation (indicated by double arrow 105) between the axle nut 102 and the axle 100. The axle nut 102 may comprise an external face 110 and a crimping ring 109 that includes a radial face 111.

The axle nut 102 may be used to keep a wheel hub in place in the axial direction along the length of the axle 100. The wheel hub may be a component in a wheel assembly that keeps a wheel of a vehicle coupled to the axle 100 and allows the wheel to rotate with respect to the vehicle without translation of the wheel assembly in the axial direction. The axle nut 102 can, however, move in the axial direction by rotating relative to the axle 100 on the threads 104. Accordingly, relative rotation between the axle nut 102 and the axle 100 is inhibited to inhibit axial translation of the axle nut 102 and thus the wheel assembly.

Relative rotation of the axle nut 102 and the axle 100 may be inhibited by crimping a crimped portion 108 of the axle nut 102. The crimped portion 108 of the axle nut 102 may extend into a slot 106 of the axle 100. The crimped portion 108 thus inhibits relative rotational movement between the axle nut 102 and the axle 100. The axle nut 102 may have an outer diameter OD. One or more tools may be configured to fit over the outer diameter OD of the axle nut 102 as will be described in greater detail herein.

Figure 2:
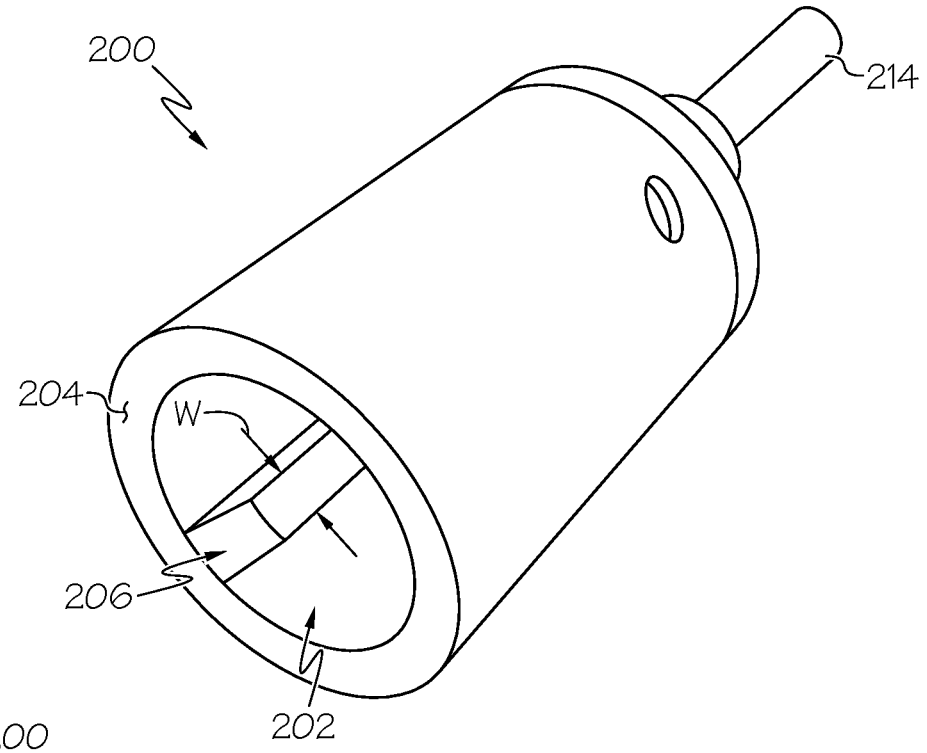
FIG. 2 depicts a crimp socket including an aperture and a sloped key, according to one or more embodiments shown and described herein.
Figure 3:
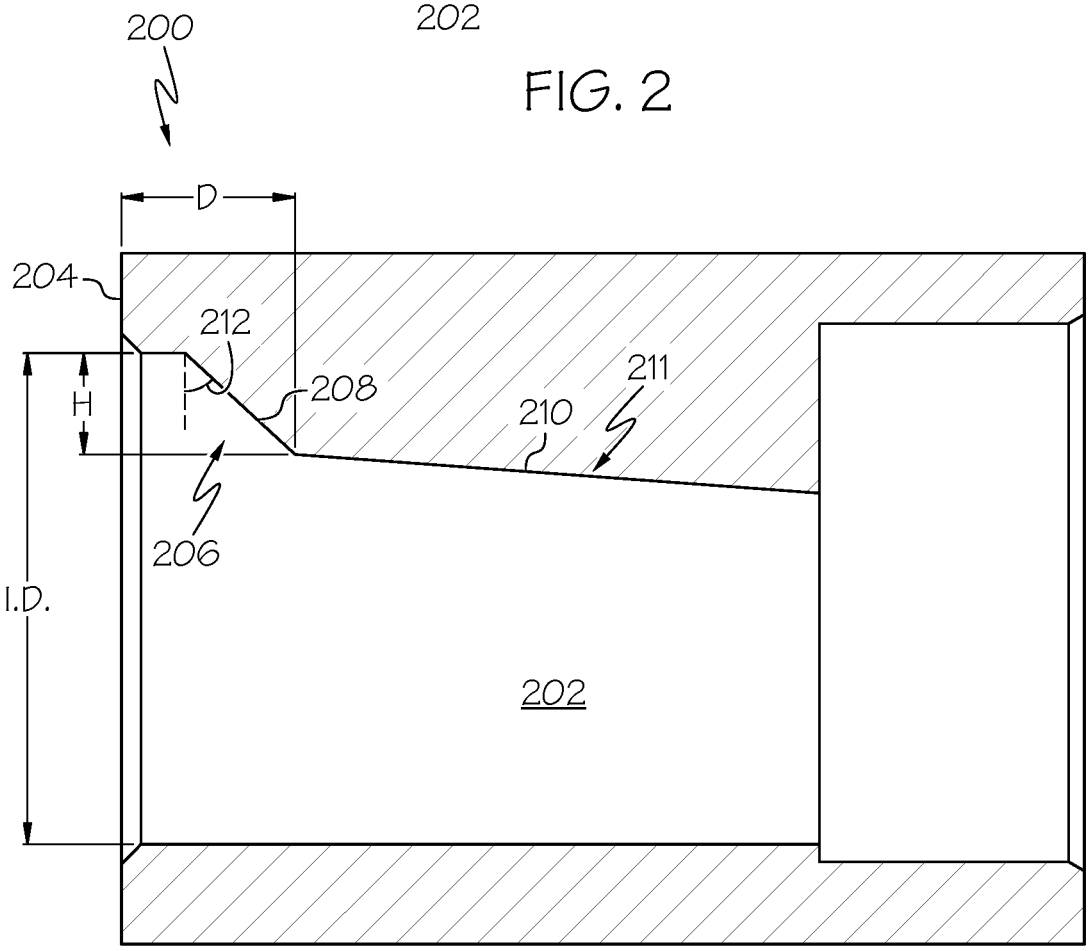
FIG. 3 depicts a cross section of the crimp socket of FIG. 2, according to one or more embodiments shown and described herein.

Referring now to FIGS. 2 and 3, a crimp socket 200 for crimping the axle nut 102 of FIG. 1 is shown. The crimp socket 200 includes an aperture 202, a socket face 204, and a sloped key 206. The sloped key 206 may project a depth D longitudinally into the aperture 202 and may extend radially into the aperture 202 to a height H. In some embodiments, the height H is a function of the depth D, such that as the sloped key 206 extends further into the aperture 202, the height H increases in a ramp-like fashion.

An internal diameter ID of the crimp socket 200 may be configured such that the aperture 202 of the crimp socket 200 fits over the outer diameter OD of the axle nut 102 (FIG. 1). Additionally, the sloped key 206 may have a width dimension W configured to fit within the slot 106 of the axle 100 (FIG. 1). Accordingly, the crimp socket 200 can fit over the axle nut 102 such that the socket face 204 contacts the external face 110 of the axle nut 102 (FIG. 1). As will be explained in greater detail herein, as the crimp socket 200 contacts the external face 110 and is pushed into the axle nut 102 in an axial direction, the sloped key 206 crimps the crimped portion 108 of the axle nut 102 (FIG. 1). In some embodiments, the crimp socket 200 may be made from a metal or a metal alloy. Further, the sloped key 206 may be a monolithic part of the crimp socket 200.

As shown in FIG. 3, the sloped key 206 may include a crimping portion 208 and an alignment portion 210. The alignment portion 210 may maintain alignment of the sloped key 206 with the slot 106 in the axle 100 (FIG. 1) As shown in FIG. 3, the alignment portion 210 has a sloped profile, with a slope having a lesser magnitude than that of the slope of the crimping portion 208, but it is contemplated that in some embodiments, the alignment portion 210 has a flat profile. The alignment portion 210 may have a flat surface 211 or a rounded surface. The slope of the surface 211 can affect the profile of the crimped portion 108 (FIG. 1). The crimping portion 208 may have a crimping angle 212 that may be selected based on the desired geometry of the crimped portion 108 within the slot 106 (FIG. 1). The crimping angle 212 may be measured as compared to the socket face 204 or to a line that is parallel with the socket face 204. Non-limiting examples of the crimping angle 212 include 40 degrees, 45 degrees, 50 degrees, 55 degrees, and 60 degrees. However, it is to be understood that other crimping angles are contemplated.

Referring now to FIG. 2, the crimp socket 200 may include an arm 214 that extends rearwardly from the crimp socket 200 (i.e., opposite from the socket face 204). The arm 214 may extend into a portion of a hammer and moveably couple the crimp socket 200 to the hammer as will be described in greater detail herein.

Figure 4:
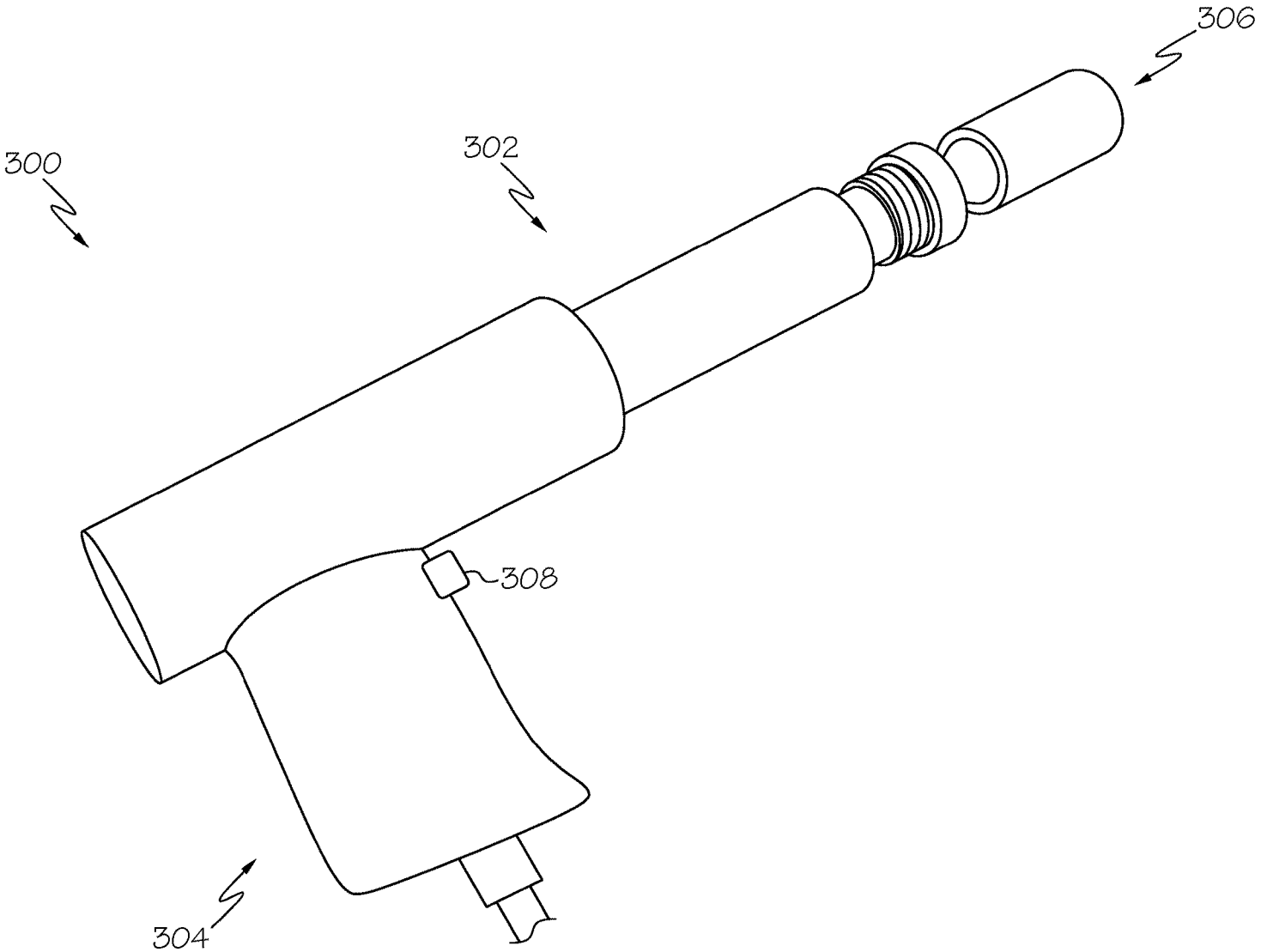
FIG. 4 depicts a pistol-grip air hammer including a crimp socket, according to one or more embodiments shown and described herein.

Referring now to FIG. 4, an air hammer 300 for crimping an axle nut, such as the axle nut 102 of FIG. 1, is shown. The air hammer 300 includes a hammer portion 302 for connecting with and hammering an external tool 306, and a grip portion 304. In some embodiments, the external tool 306 may be the crimp socket 200 of FIGS. 2 and 3. The grip portion 304 may include a trigger 308. In embodiments, the weight of the air hammer 300 and the shape of the grip portion 304 may be such that the air hammer 300 can be manipulated using a single hand. In some embodiments, the air hammer 300 may be a pistol-grip air hammer.

The hammer portion 302 may include an aperture for receiving the arm 214 of the crimp socket 200 (FIG. 2) and a hammer pin. The hammer pin may be air powered and may reciprocate back and forth within the hammer portion 302, striking the external tool 306. For example, the hammer pin may strike the arm 214 of the crimp socket 200 (FIG. 2) and cause the crimp socket 200 (FIG. 2) to move with respect to the air hammer 300. For example, the crimp socket 200 may move in an axial direction of the axle 100 of FIG. 1 to crimp the axle nut 102 such that the crimped portion 108 of the axle nut 102 extends into the slot 106 of the axle 100.

In some embodiments, activation of the air hammer 300 may be based on a pressure placed on the external tool 306 in the axial direction. That is, exerting a triggering pressure on the external tool 306 may cause the hammer pin to strike the external tool 306 and reciprocate the air hammer 300. In some embodiments, the triggering pressure may be adjustable. In one non-limiting embodiment, the trigger 308 has a wheel shape and is rotatable within the grip portion 304 to adjust the triggering pressure. In such embodiments, the trigger 308 may be rotated to set the triggering pressure to a desired pressure and the trigger 308 may be pulled in the axial direction, permitting the hammer pin to strike the external tool 306 when sufficient pressure is applied in the axial direction to the external tool 306.

Now referring to FIGS. 1-4, operation of the air hammer 300 to crimp an axle nut 102 to an axle 100 is described. The air hammer 300 may be coupled with a crimp socket 200 for crimping an axle nut 102 to an axle 100. A user may grasp the air hammer 300 by the grip portion 304. Because the weight of the air hammer 300 and the shape of the grip portion 304 permit single-handed use, a user may hold the air hammer 300 with one hand and adjust the angle of rotation of the crimp socket 200 with respect to the air hammer 300 and the axle 100 such that the sloped key 206 is aligned with the slot 106 (i.e., may rotate the crimp socket 200 in the direction indicated by double arrow 105 of FIG. 1). Accordingly, the user need not rotate the air hammer 300 itself or adjust the rotation of the axle nut 102 with respect to the axle 100.

A user may then move the air hammer 300 including the crimp socket 200 forward in the axial direction (−Y direction as shown by the axis in FIG. 1) such that the axle nut 102 is inside the aperture 202 of the crimp socket 200. The user may continue to move the air hammer 300 forward in the axial direction until the socket face 204 presses against the external face 110 of the axle nut 102. Once pressure exceeding the triggering pressure is applied to the crimp socket 200 and the trigger 308 is pulled, the air hammer 300 will trigger and the hammer pin will strike the arm 214 of the crimp socket 200, forcing the crimp socket 200 forward. The sloped key 206 contacts the radial face 111 of the crimping ring 109 and forces the crimping ring 109 into the slot 106, crimping the axle nut 102 to the axle 100 and inhibiting relative rotational motion between the axle nut 102 and the axle 100.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A crimping device comprising:

a hammer; and a crimp socket that includes an aperture, a socket face defined by a sidewall and a sloped key that projects radially inward from the sidewall beyond the socket face and extends at least a portion of a depth of the aperture, wherein the height of the sloped key increases along the depth of the aperture.

2. The crimping device of claim 1, wherein the hammer is pressure activated at a triggering pressure.

3. The crimping device of claim 2, wherein the triggering pressure is adjustable.

4. The crimping device of claim 3, wherein the crimp socket is detachable from the hammer.

5. The crimping device of claim 1, wherein the hammer is a pistol-grip air hammer.

6. The crimping device of claim 1, wherein:

the crimp socket is sized to extend over an axle comprising a slot and an axle nut;

the sloped key is sized to be received by the slot; and the sloped key is sized to crimp down on a crimped portion of the axle nut as the crimp socket moves in an axial direction.

7. The crimping device of claim 1, wherein the crimp socket has a crimping portion and an alignment portion and a magnitude of a slope of the crimping portion is greater than a magnitude of a slope of the alignment portion along the depth of the aperture.

8. A method of crimping an axle nut to an axle, the method comprising:

positioning a crimp socket including an aperture, a socket face, and a sloped key that projects radially into the crimp socket and that extends at least a portion of a depth of the aperture over the axle, and moving the crimp socket in an axial direction to crimp down on a crimped portion of the axle nut to crimp the crimped portion into a slot of the axle.

9. The method of claim 8, wherein the crimp socket is moved in the axial direction by a pistol-grip air hammer.

10. The method of claim 9, wherein the pistol-grip air hammer triggers at a triggering pressure.

* * * * *